US011369977B2

(12) United States Patent
Örtegren

(10) Patent No.: US 11,369,977 B2
(45) Date of Patent: Jun. 28, 2022

(54) HIGH SPEED CLEANING OF A CENTRIFUGAL SEPARATOR

(71) Applicant: Alfdex AB, Landskrona (SE)

(72) Inventor: Anders Örtegren, Häljarp (SE)

(73) Assignee: ALFDEX AB, Landskrona (SE)

( * ) Notice: Subject to any disclaimer, the term of this patent is extended or adjusted under 35 U.S.C. 154(b) by 492 days.

(21) Appl. No.: 16/321,244

(22) PCT Filed: Aug. 17, 2017

(86) PCT No.: PCT/EP2017/070862
§ 371 (c)(1),
(2) Date: Jan. 28, 2019

(87) PCT Pub. No.: WO2018/036905
PCT Pub. Date: Mar. 1, 2018

(65) Prior Publication Data

US 2019/0160477 A1 May 30, 2019

(30) Foreign Application Priority Data

Aug. 25, 2016 (EP) ..... 16185699

(51) Int. Cl.
*B04B 15/06* (2006.01)
*B04B 5/08* (2006.01)
(Continued)

(52) U.S. Cl.
CPC ..... *B04B 15/06* (2013.01); *B04B 5/08* (2013.01); *B04B 5/12* (2013.01); *B04B 9/10* (2013.01);
(Continued)

(58) Field of Classification Search
CPC .. B04B 15/06; B04B 5/08; B04B 5/12; B04B 9/10; B04B 2005/125; B04B 5/00;
(Continued)

(56) References Cited

U.S. PATENT DOCUMENTS 4,515,582 A * 5/1985 Cox-Smith ..... B04B 11/043 494/7
4,791,942 A 12/1988 Rickett et al.
(Continued)

FOREIGN PATENT DOCUMENTS

CN 85105765 A 1/1987
CN 1272071 A 11/2000
(Continued)

OTHER PUBLICATIONS

English translations of the Russian Office Action and Search Report, dated May 30, 2019, for Russian Application No. 2019108083.
(Continued)

*Primary Examiner* — Walter D. Griffin
*Assistant Examiner* — Shuyi S. Liu
(74) *Attorney, Agent, or Firm* — Birch, Stewart, Kolasch & Birch, LLP

(57) ABSTRACT

A centrifugal separator for cleaning gas containing contaminants includes a stationary casing, enclosing a separation space through which a gas flow is permitted, a gas inlet extending through the stationary casing and permitting supply of the gas to be cleaned, a rotating member including a plurality of separation members arranged in said separation space and being arranged to rotate around an axis of rotation, a gas outlet configured to permit discharge of cleaned gas and including an outlet opening through a wall of the stationary casing, a drainage outlet configured to permit discharge of liquid impurities separated from the gas to be cleaned, and a drive member, for rotating the rotating member. The centrifugal separator further includes a control unit configured to control the drive member to rotate the rotating member at a first speed during a separation phase and at a second speed, which is higher than the first speed, during a cleaning phase to remove clogging on or between
(Continued)

said separation members, wherein the cleaning phase is shorter in time than the separation phase.

20 Claims, 3 Drawing Sheets

(51) Int. Cl.
*B04B 5/12* (2006.01)
*B04B 9/10* (2006.01)
*F01M 13/04* (2006.01)

(52) U.S. Cl.
CPC ..... *F01M 13/04* (2013.01); *B04B 2005/125* (2013.01); *F01M 2013/0422* (2013.01); *F01M 2013/0427* (2013.01)

(58) Field of Classification Search
CPC ..... F01M 13/04; F01M 2013/0422; F01M 2013/0427; B01D 45/00; B01D 45/14
USPC ..... 494/1, 7, 9, 10
See application file for complete search history.

(56) References Cited

U.S. PATENT DOCUMENTS

| | | | | |
|---|---|---|---|---|
| 6,783,571 | B2 | 8/2004 | Ekeroth | |
| 8,657,908 | B2 | 2/2014 | Eliasson | |
| 8,794,222 | B2 | 8/2014 | Schwandt et al. | |
| 8,807,097 | B2 | 8/2014 | Schwandt et al. | |
| 10,512,919 | B2 | 12/2019 | Eliasson | |
| 10,532,365 | B2 | 1/2020 | Eliasson | |
| 2003/0233932 | A1 | 12/2003 | Ekeroth | |
| 2003/0233939 | A1 | 12/2003 | Szepessy et al. | |
| 2004/0226442 | A1* | 11/2004 | Olsson | B04B 5/12 95/270 |
| 2005/0007046 | A1 | 1/2005 | Schneider et al. | |
| 2005/0087336 | A1 | 4/2005 | Surjaatmadja et al. | |
| 2005/0126958 | A1 | 6/2005 | Bohlig et al. | |
| 2009/0025562 | A1 | 1/2009 | Hallgren et al. | |
| 2012/0174537 | A1 | 7/2012 | Törnblom et al. | |
| 2012/0174541 | A1 | 7/2012 | Törnblom et al. | |
| 2013/0067873 | A1 | 3/2013 | Szepessy et al. | |
| 2013/0233290 | A1 | 9/2013 | Skoog | |
| 2014/0045669 | A1* | 2/2014 | Osawa | B04B 15/02 494/9 |
| 2014/0050633 | A1 | 2/2014 | Van Der Schaaf et al. | |
| 2014/0237961 | A1 | 8/2014 | Szepessy | |
| 2014/0371113 | A1 | 12/2014 | Fout et al. | |

FOREIGN PATENT DOCUMENTS

| | | | | |
|---|---|---|---|---|
| CN | 1671952 | A | 9/2005 | |
| CN | 1327931 | C | 7/2007 | |
| CN | 101203319 | A | 6/2008 | |
| CN | 101237938 | A | 8/2008 | |
| CN | 102470378 | A | 5/2012 | |
| CN | 102612411 | A | 7/2012 | |
| CN | 203108316 | U | 8/2013 | |
| CN | 103357218 | A | 10/2013 | |
| CN | 103357518 | A | 10/2013 | |
| CN | 103608102 | A | 2/2014 | |
| CN | 103917497 | A | 7/2014 | |
| CN | 105188947 | A | 12/2015 | |
| CN | 106232237 | A | 12/2016 | |
| CN | 106232238 | A | 12/2016 | |
| EP | 1136131 | A2 | 9/2001 | |
| EP | 2 980 373 | A1 | 2/2016 | |
| GB | 2 116 752 | A | 9/1983 | |
| JP | 1-34660 | B2 | 7/1989 | |
| JP | 2-152566 | A | 6/1990 | |
| JP | 3-293045 | A | 12/1991 | |
| JP | 10-128158 | A | 5/1998 | |
| JP | 2002519183 | A | 7/2002 | |
| JP | 2005-530096 | A | 10/2005 | |
| JP | 2005-530947 | A | 10/2005 | |
| JP | 2013-537280 | A | 9/2013 | |
| JP | 2015-123444 | A | 7/2015 | |
| KR | 10-2008-0020620 | A | 3/2008 | |
| MX | 2014003808 | A | 7/2014 | |
| RU | 2315872 | C2 | 1/2008 | |
| RU | 2317429 | C2 | 2/2008 | |
| RU | 2424039 | C2 | 7/2011 | |
| RU | 2428241 | C2 | 9/2011 | |
| RU | 2469796 | C2 | 12/2012 | |
| RU | 2500481 | C1 | 12/2013 | |
| RU | 2518921 | C1 | 6/2014 | |
| RU | 2522834 | C2 | 7/2014 | |
| WO | WO 99/16550 | A1 | 4/1999 | |
| WO | WO 2004/001200 | A1 | 12/2003 | |
| WO | WO 2004/001201 | A1 | 12/2003 | |
| WO | WO-2004001200 | A1 * | 12/2003 | F01M 11/10 |
| WO | WO 2007/094724 | A1 | 8/2007 | |
| WO | WO 2007/094725 | A1 | 8/2007 | |
| WO | WO 2007/094726 | A1 | 8/2007 | |
| WO | WO 2009/126094 | A1 | 10/2009 | |
| WO | WO 2010/008342 | A1 | 1/2010 | |
| WO | WO 2011/053224 | A1 | 5/2011 | |
| WO | WO 2013/067245 | A1 | 5/2013 | |
| WO | WO 2014/155613 | A1 | 10/2014 | |
| WO | WO 2014/177579 | A1 | 11/2014 | |

OTHER PUBLICATIONS

Written Opinion of the International Searching Authority and International Search Report, dated, Oct. 30, 2017, for International Application No. PCT/EP2017/070864.
International Search Report (PCT/ISA/210) issued in PCT/EP2017/070862, dated Nov. 27, 2017.
Written Opinion (PCT/ISA/237) issued in PCT/EP2017/070862, dated Nov. 27, 2017.
English translation of the Russian Decision to Grant and Search Report, dated Sep. 13, 2019, for Russian Application No. 2019108052.
China Electric Power Press, "Professional Examination Review Guidebook of Qualification Examination for Registered Electrical Engineers in Power Distribution Major," Jun. 30, 2007, 1st Edition, pp. 538-543 (7 pages total).
English translations of the Chinese Office Action and Search Report, dated Jun. 2, 2020, for Chinese Application No. 201780051602.1.
English translations of the Chinese Office Aclion and Search Report, dated Jun. 3, 2020, for Chinese Application No. 201780051617.8.
European Communication pursuant to Article 94(3) EPC for European Application No. 16185689.3, dated Sep. 18, 2020.
English translation of Korean Office Action for Korean Application No. 10-2019-7008013, dated Apr. 20, 2020.
English translation of Korean Office Action for Korean Application No. 10-2019-7008014, dated Apr. 20. 2020.
Office Action issued in Japan Patent Application No. 2019-510923, dated Feb. 17, 2020.
Office Action issued in Japan Patent Application 2019-510913 dated Feb. 25, 2020.
Chinese Office Action, dated Feb. 20, 2021, in Application No. 201780051602.1.
Industrial Electronics, Huang Congliang, Scholars Books Co., Ltd., pp. 473-474, Sep. 30, 1986, 1st edition).
Translation of Japanese Office Action, dated Feb. 25, 2020, in Application No. 2019-510913.

* cited by examiner

HIGH SPEED CLEANING OF A CENTRIFUGAL SEPARATOR

FIELD OF THE INVENTION

The present invention relates to the field of centrifugal separators for cleaning a gas containing liquid impurities. In particular, the present invention relates to cleaning crankcase gases of a combustion engine from oil particles.

BACKGROUND OF THE INVENTION

It is well known that a mixture of fluids having different densities may be separated from one another through use of a centrifugal separator. One specific use of such a separator is in the separation of oil from gas vented from a crankcase forming part of an internal combustion engine.

With regard to this specific use of separators, there can be a tendency for the high pressure gas found in the combustion chambers of an internal combustion engine to leak past the associated piston rings and into the crankcase of the engine. This continuous leaking of gas into the crankcase can lead to an undesirable increase of pressure within the crankcase and, as a consequence, to a need to vent gas from the casing. Such gas vented from the crankcase typically carries a quantity of engine oil (as droplets or a fine mist), which is picked up from the reservoir of oil held in the crankcase.

In order to allow vented gas to be introduced into the inlet system without also introducing unwanted oil (particularly into a turbocharging system wherein the efficiency of the compressor can be adversely affected by the presence of oil), it is necessary to clean the vented gas (i.e. to remove the oil carried by the gas) prior to the gas being introduced into the inlet system. This cleaning process may be undertaken by a centrifugal separator, which is mounted on or adjacent the crankcase and which directs cleaned gas to the inlet system and directs separated oil back to the crankcase. An example of such a separator is disclosed e.g. in U.S. Pat. No. 8,657,908.

Such separators usually comprise a number of separation discs, e.g. arranged in a stack or as axially extending surface plates, and the separation of oil from the gas takes place between such discs. However, during running of the separator, clogging between such discs may occur, which in turn decreases the separation performance of the separator.

There is thus a need in the art for arrangements that prevent clogging from occurring and for cleaning already clogged separation discs.

SUMMARY OF THE INVENTION

A main object of the present invention is to provide a centrifugal separator for cleaning gas that may prevent clogging and decrease the amount of clogging between separation discs.

As a first aspect of the invention, there is provided a centrifugal separator for cleaning gas containing contaminants comprising

- a stationary casing, enclosing a separation space through which a gas flow is permitted,
- a gas inlet extending through the stationary casing and permitting supply of the gas to be cleaned,
- a rotating member comprising a plurality of separation members arranged in the separation space and being arranged to rotate around an axis (X) of rotation,

- a gas outlet configured to permit discharge of cleaned gas and comprising an outlet opening through a wall of the stationary casing,
- a drainage outlet configured to permit discharge of liquid impurities separated from the gas to be cleaned;
- a drive member, for rotating the rotating member; and wherein the centrifugal separator further comprises

- a control unit which is configured to control the drive arrangement to rotate the rotating member at a first speed during a separation phase and at a second speed, which is higher than the first speed, during a cleaning phase to remove clogging on or between the separation members, wherein the cleaning phase is shorter in time than the separation phase.

The contaminants in the gas may comprise liquid impurities, such as oil, and soot.

Consequently, the centrifugal separator may be for separating liquid impurities, such as oil, from gas. The gas may be crankcase gas of a combustion engine. However, the centrifugal separator may also be suitable for cleaning gases from other sources, for instance the environment of machine tools which frequently contains large amounts of liquid impurities in the form of oil droplets or oil mist.

The stationary casing of the centrifugal separator may comprise a surrounding side wall, and first and second end walls, which enclose the separation space. The stationary casing may have a cylindrical shape with circular cross-section having a radius R from the axis (X) of rotation to the surrounding side wall. This radius R may be constant at least with respect to a major part of the circumference of the surrounding side wall. The stationary casing may also be slightly conical. The first and second end walls may thus form an upper end wall and a lower end wall of the cylindrical shaped casing.

The gas inlet of the centrifugal separator may be located through the first end wall or through the surrounding side wall close to the first end wall, thus at the top of the separator, such that gas entering through the gas inlet is directed to the separation space. The drainage outlet may be located in the second end wall, e.g. at the bottom of the separator. Thus, the drainage outlet may be arranged centrally in an end wall opposite the end wall through which, or at which, the inlet is arranged. The drainage outlet of the centrifugal separator may further be formed by a number of spot shaped through holes of the stationary casing or by a single drainage passage. The drainage outlet may be arranged at the axis of rotation or centered on the axis of rotation. The drainage outlet may also be in an annular collection groove at the inner end wall of the stationary casing. The gas outlet may be arranged in a surrounding side wall of the stationary casing or may for example be arranged in an end wall, such as the end wall opposite the end wall through which, or at which, the gas inlet is arranged.

The rotating member is arranged for rotation during operation by means of the drive member. The rotating member comprises a plurality of separation members arranged in the separation space. The separation members of the rotating member are examples of surface-enlarging inserts that promote separation of contaminants from the gas. The separation members may be a stack of separation discs. The separation discs of the stack may be frustoconical. A frustoconical disc may have a planar portion extending in a plane that is perpendicular to the axis of rotation, and a frusto-conical portion that may extend upwards or downwards. The planar portion may be closer to the rotational axis than the frustoconical portion. Further, the discs of the stack may be radial discs, in which substantially the whole disc extends in a plane that is perpendicular to the axis of rotation.

It is also to be understood that the separation members, such as separation discs, not necessarily have to be arranged in a stack. The separation space may for example comprise axial discs, or plates that extend around the axis of rotation. The axial discs or plates may be planar, i.e. extending in planes that are parallel to the axis of rotation. The axial discs or plates may also have a slightly or significantly curved shape, such as an arcuate or spiral shape, as seen in a radial plane.

During operation, gas to be cleaned may be directed centrally through the plurality of separation members, such as centrally through the stack of separation discs. In such a set-up, the rotating member may further define a central space formed by at least one through hole in each of the separation members. This central space is connected to the gas inlet and configured to convey the gas to be cleaned from the gas inlet to the gaps between the separation members, such as between the gaps between the discs of a stack of separation discs. A separation disc that may be used as separation member may comprise a central, essentially flat portion perpendicular to the axis of rotation. This portion may comprise the through holes that form the central space.

Thus, the centrifugal separator may be configured to lead crankcase gases from the gas inlet into a central portion of the rotating member. In this manner the crankcase gases may be "pumped" from the central portion of the rotating member into the interspaces between the separation discs in the stack of separation discs by the rotation of the rotating member. Thus, the centrifugal separator may work according to the concurrent flow principle, in which the gas flows in the disc stack from a radial inner part to a radial outer part, which is opposite to a separator operating according to the counter-current flow principle, in which the gas is conducted into the centrifugal rotor at the periphery of the rotor and is led towards a central part of the rotor.

The drive member may for example comprise a turbine wheel, rotated by means of an oil jet from the lubrication oil system of the combustion engine or a free jet wheel comprising a blow-back disk. However, the drive member may also be independent of the combustion engine and comprise an electrical motor, a hydraulic motor or a pneumatic motor.

The centrifugal separator further comprises a control unit configured to control the rotational speed of the rotating member via the drive arrangement, e.g. such that a limited number of speeds can be obtained or so that a continuous change of the rotational speed can be performed. The control unit may comprise a processor and an input/output interface for communicating with the drive arrangement and for receiving information from other parts of the separator, such as from sensors arranged on the separator, and/or from e.g. an engine to which the centrifugal separator is connected or mounted.

The control unit may further comprise computer program products configured for switching between separating phase and cleaning phase. The computer program may be for analysing received information from e.g. the engine or sensors and send operational requests based on such analysis to the drive arrangement.

The control unit is at least able to control the drive arrangement to switch from rotating at a first speed during the separation phase and at a second, higher speed, during the cleaning phase. The first speed during the separation phase may be the normal operational speed of the centrifugal separator during which the continuous separation of contaminants from the gas occurs.

The control unit is also configured to control the drive arrangement to increase its speed, i.e. to switch from the separation phase to the cleaning phase. The cleaning phase is shorter in time compared to the separation phase. During the cleaning phase, clogging that has stuck between the separation members may be removed. Switching to the cleaning phase may be performed as a stepwise increase in speed up to the speed of the cleaning phase, or it may be performed as a quick increase in speed up to the speed of the cleaning phase.

The control unit is also configured to control the drive arrangement to the decrease its speed when switching from the cleaning phase back to the separation phase. However, the separation phase may comprise running at different rotational speeds, all of which are lower than the rotational speed during the cleaning phase.

Consequently, the centrifugal separator according to the invention is operating in a cycle comprising the separation phase and the cleaning phase.

Clogging refers to contaminants stuck between the separation members that obstruct or impede the flow of gas between the separation members. The clogging may originate from contaminants in the gas. The clogging may be formed by sticky matter and may comprise oil and particles.

The first aspect of the invention is based on the insight that clogging that may arise between separation members of a gas separator can be removed using a temporary increase in rotational speed. By increasing the speed also the centrifugal forces acting on the clogging increase, which may then come loose and be forced out from between the separation members. Thus, such a temporary boost in centrifugal force may clean the separation members from e.g. oil mist and particles that are clogged between the separation members. Further, the increase in speed may also prevent the formation of clogging.

In embodiments of the first aspect of the invention, the control unit is configured to switch from the separation phase to the cleaning phase after a predetermined period of time.

Thus, the control unit may be configured to control the drive arrangement to rotate the rotating member at the first speed for a predetermined time. After the predetermined time in the separation phase, the control unit may automatically initiate a cleaning phase, whereby clogging is removed from between the separation members. A predetermined time could be manually set by an operator. However, it could also be calculated from operating parameters of the centrifugal separator measured by various sensors, such as sensors registering a pressure at the gas inlet and/or gas outlet of the separator.

In embodiments of the first aspect of the invention the control unit is configured to receive a signal that is related to a stop of the engine to which the centrifugal separator is connected, and wherein the control unit is further configured to switch to the cleaning phase after a predetermined number of stops of the engine.

Thus, the control unit may be configured to count the number of stops of an engine to which the centrifugal separator is connected and then switch to the cleaning phase when the counted number of stops reaches a predetermined value. The predetermined value may for example be a count of 20 stops, a count of 50 stops etc.

In embodiments of the first aspect of the invention, the control unit is configured to receive a signal that is related to the time during which an engine to which the centrifugal separator may be connected has been running, and wherein the control unit is further configured to switch to the cleaning phase when the time exceeds a threshold value.

Thus, the control unit may be configured to register the operating time of an engine to which the centrifugal separator is connected and then switch to the cleaning phase when the operating time exceeds a threshold value, such as 100 hours, 150 hours etc.

In embodiments of the first aspect of the invention, the control unit is configured to receive a signal related to the gas pressure at the gas inlet and switch to the cleaning phase when the gas pressure at the gas inlet is above a predefined threshold value.

Consequently, the centrifugal separator may comprise at least one pressure sensor at the gas inlet. An increased gas pressure at the inlet may be a good indication that clogging has occurred between the separation members.

The gas pressure at the gas inlet may be measured at a specific rotational speed of the rotational member, and when this pressure is over a specific value, switching to the cleaning phase may occur.

The control unit may further be configured to receive several parameters, such as two or more parameters selected from the group consisting of a parameter related to the number of stops of the engine, a parameter related to the operating time of the engine, a parameter related to the operating time of the centrifugal separator and a parameter related to the gas pressure at the inlet. The control unit may then be configured to switch to the cleaning phase when one of those parameters exceeds a threshold value specific for that parameter.

According to another embodiment of the invention, the control unit is configured to control the drive arrangement to rotate the rotating member at the second speed for a predetermined time. A predetermined time could be manually set by an operator. However, it could also be calculated from operating parameters of the centrifugal separator measured by various sensors, such as sensors registering a pressure at the gas inlet and/or gas outlet of the separator. After the predetermined time, the control unit may be configured to switch back to the separation phase.

As an alternative, the control unit may be configured to switch from the cleaning phase back to the separation phase after receiving a signal related to the gas pressure at the gas inlet. As an example, the control unit may be configured to switch back to the separation phase when receiving a signal indicating that the gas pressure at the gas inlet is below a predetermined value.

In embodiments of the first aspect of the invention, the cleaning phase comprises rotating the rotating member during a time period that is between 30-180 s.

As an example, the cleaning phase may comprise rotating the rotating member during a time period that is between 60-120 s.

In embodiments of the first aspect of the invention, the cleaning phase comprises rotating the rotating member at a speed that is higher than 12,000 rpm.

As an example, the cleaning phase comprises rotating the rotating member at a speed that is higher than 14,000 rpm, such as higher than 15,000 rpm.

In embodiments of the first aspect of the invention, the separation phase comprises rotating the rotating member at a speed of between 7,500 and 12,000 rpm.

Thus, in embodiments of the first aspect of the invention, the second speed is more than 2000 rpm higher than the first speed, such more than 3000 rpm higher than the first speed, such as more than 4000 rpm higher than the first speed, such as more than 5000 rpm higher than the first speed.

Consequently, in embodiments of the first aspect of the invention, the cleaning phase comprises rotating the rotating member at a speed that is more than 2000 rpm higher than the speed of the separation phase.

In embodiments of the first aspect of the invention, the drive member comprises an electrical motor.

Thus, the control equipment may be configured for driving such an electrical motor at different speeds. The electrical motor may principally be of any suitable kind, for instance a direct-current motor or an alternate-current motor (synchronous motor or asynchronous motor). As an example, the electrical motor may be a synchronous motor, such as a brushless electric motor, having a rotor that includes permanent magnets having a rotor that includes permanent magnets.

The electrical motor may be arranged within the stationary casing or outside the stationary casing.

Furthermore, an electrical motor which does not have separate bearings for the journalling of the rotor of the motor may be used. The already present and necessary bearings for the centrifugal rotor may instead be used for this journalling.

As an example, the electrical motor may be arranged within the stationary casing and have a stator that is supported by the stationary casing, and a rotor, that is constituted by part of the rotating member of the centrifugal separator and which is journalled relative to the stator only through the bearings.

Consequently, in embodiments of the first aspect of the invention, the rotating member is journalled in the stationary casing through bearings situated at only two bearing places axially spaced from each other, and the drive member is an electrical motor arranged within the stationary casing and having a stator, that is supported by the stationary casing, and a rotor, that is constituted by part of the rotating member and is journalled relative to the stator only through those bearings.

Such a configuration is for example explained in more detail in the international patent application published as WO 2004/001201.

As a further example, the control unit may be integrated with the electrical motor.

Thus, the control equipment may be configured for driving the electrical motor at different speeds. The control unit may thus be in the same unit as the electrical motor, which may be arranged within the stationary casing or outside the stationary casing. However, the control unit may also be a separate unit than the electrical motor. Thus, the control unit may be a separate unit arranged outside the stationary casing whereas the electrical motor is arranged within the stationary casing, or as an alternative, both the electrical motor and the control unit are arranged outside the stationary casing, but as different units.

As a second aspect of the invention, there is provided a method for removing clogging in a centrifugal separator, comprising the steps of

- providing a centrifugal separator according to the first aspect of the invention,
- running the centrifugal separator in the separation phase at a first speed,
- switching to running the centrifugal separator in the cleaning phase at the second speed to remove clogging on or between the separation members.

Terms and definitions used in relation to the second aspect of the invention are as discussed in relation to the first aspect of the invention above.

The step of running the centrifugal separator in the separation phase and in the cleaning phase comprises rotating the rotating member of the centrifugal separator.

The method may further comprise the steps of introducing gas containing contaminants into gas inlet of the centrifugal separator; and discharging cleaned gas through the gas outlet of the centrifugal separator and discharging contaminants separated from the gas through the drainage outlet of the centrifugal separator.

In embodiments of the second aspect of the invention, the step of switching to running the centrifugal separator in the cleaning phase is initiated after a predetermined period of time.

In embodiments of the second aspect of the invention, the method is further comprising receiving a signal related to a stop of the engine to which the centrifugal separator is connected and wherein switching to running the centrifugal separator in the cleaning phase is initiated after a predetermined number of received stops.

In embodiments of the second aspect of the invention, the method is further comprising measuring a pressure at the inlet of the separator and wherein switching to running the centrifugal separator in the cleaning phase is initiated when the gas pressure at the gas inlet is above a predefined threshold value.

As a further aspect of the invention, there is provided a computer program product, comprising program code instructions for executing the method according of the second aspect of the invention, when said program is executed by a computer. As an example, the separator control unit may comprise such a computer program product.

DETAILED DESCRIPTION

The centrifugal separator and method according to the present disclosure will be further illustrated by the following description with reference to the accompanying drawings.

Figure 1:
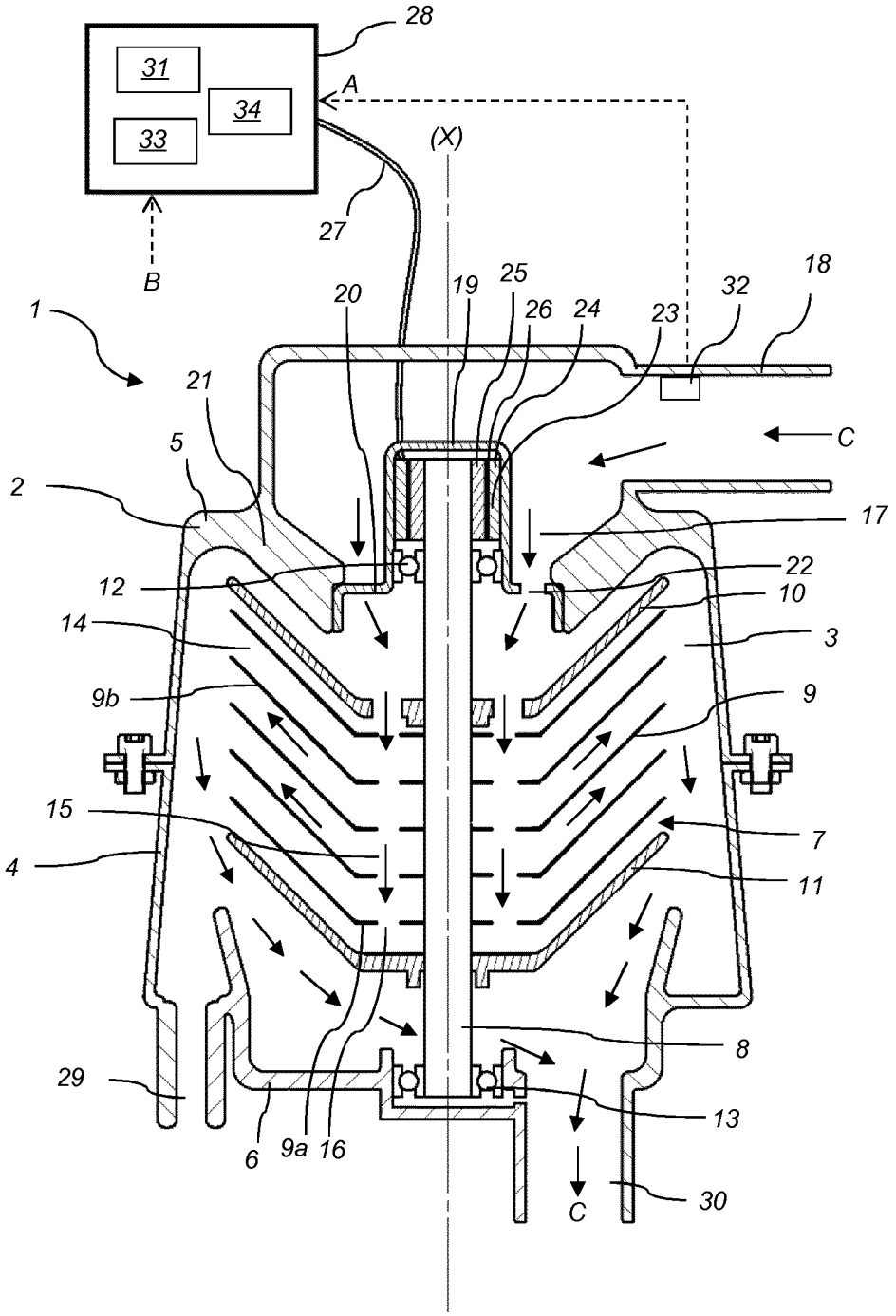
FIG. 1 shows a section of an embodiment of a centrifugal separator.

FIG. 1 shows a section of a centrifugal separator 1 of the separator arrangement. The centrifugal separator 1 comprises a stationary casing 2, which is configured to be mounted to a combustion engine (not disclosed), especially a diesel engine, at a suitable position, such as on top of the combustion engine or at the side of the combustion engine.

It is to be noted that the centrifugal separator 1 is also suitable for cleaning gases from other sources than combustion engines, for instance the environment of machine tools which frequently contains large amounts of liquid impurities in the form of oil droplets or oil mist.

The stationary casing 2 encloses a separation space 3 through which a gas flow is permitted. The stationary casing 2 comprises, or is formed by, a surrounding side wall 4, a first end wall 5 (in the embodiments disclosed an upper end wall) and a second end wall 6 (in the embodiments disclosed a lower end wall).

The centrifugal separator comprises a rotating member 7, which is arranged to rotate around an axis x of rotation. It should be noted that the stationary casing 2 is stationary in relation to the rotating member 7, and preferably in relation to the combustion engine to which it may be mounted.

The stationary casing 2 has a radius from the axis x of rotation to the surrounding side wall 4 that is constant at least with respect to a major part of the circumference of the surrounding side wall 4. The surrounding side wall 4 thus has a circular, or substantially, circular cross-section.

The rotating member 7 comprises a spindle 8 and a stack of separation discs 9 attached to the spindle 8. All the separation discs of the stack 9 are provided between a first end plate 10 (in the embodiment disclosed an upper end plate) and a second end plate 11 (in the embodiment disclosed a lower end plate).

The spindle 8, and thus the rotating member 7, is rotatably supported in the stationary casing 2 by means of a first bearing 12 (in the embodiment disclosed as an upper bearing) and a second bearing 13 (in the embodiments disclosed as a lower bearing), the bearings being arranged one on each side of the stack of separation discs 9. The upper bearing 12 is supported by a cap 19 which by a cylindrical part surrounds an upper end portion of the centrifugal rotor shaft, i.e. the spindle 8, the upper end portion being situated axially above the upper bearing 12. The cap 19 also has an annular plain portion 20, through which the cap is supported by a partition 21 in the stationary casing 2. The plain annular portion 20 of the cap 19 is provided with through holes 22, through which the inlet conduit 18 communicates with the central space 15.

Axially above the upper bearing 12 the cap 19 supports on its inside, around the end portion of the spindle 8, a stator 24 belonging to an electrical motor 23. A rotor 25 belonging to this electrical motor 23 is supported by the end portion of the centrifugal rotor shaft, i.e. the spindle 8. A narrow annular slot 26 is formed between the motor stator 24 and the motor rotor 25. As can be seen, the electrical motor 23 in this embodiment has no bearings of its own, through which its rotor 25 would be rotatably journalled in its stator 24. Instead, the two bearings 12 and 13, through which the rotating member 7 is journalled in the stationary casing 2, are utilized for the journalling of the rotor 25 of the electrical motor 23.

The separation discs of the stack 9 are frusto-conical and extend outwardly and upwardly from the spindle 8. The separation discs thus comprise a flat portion 9*a*, which extend perpendicularly to the axis of rotation X, and a conical portion 9*b*, that extend outwardly and upwardly from the flat portion 9*a*.

It should be noted that the separation discs also could extend outwardly and downwardly, or even radially.

The separation discs of the stack 9 are provided at a distance from each other by means of distance members (not disclosed) in order to form gaps 14 between adjacent separation discs 9, i.e. a gap 14 between each pair of adjacent separation discs 9. The axial thickness of each gap 14 may e.g. be in the order of 1-2 mm.

The separation discs of the stack 9 may be made of plastic or metal. The number of separation discs in the stack 9 is normally higher than indicated in FIG. 1 and may be for instance 50 to 100 separation discs 9 depending of the size of the centrifugal separator.

The rotating member 7 defines a central space 15. The central space 15 is formed by a hole in each of the separation discs 9. In the embodiments of FIG. 1, the central space 15 is formed by a plurality of through holes 16, each extending through the first end plate 10 and through each of the separation discs 9, but not through the second end plate 11. The through holes are arranged in the flat portions 9*a* of the separation discs.

The centrifugal separator 1 comprises a gas inlet 17 for the supply of the gas to be cleaned. The gas inlet 17 extends through the stationary casing 2, and more precisely through the first end wall 5. The gas inlet 17 communicates with the central space 15 so that the gas to be cleaned is conveyed from the inlet 17 via the central space 15 to the gaps 14 of the stack of separation discs 9. The gas inlet 17 is configured to communicate with the crankcase of the combustion engine, or any other source, via an inlet conduit 18 permitting the supply of crankcase gas from the crankcase to the gas inlet 17 and further to the central space 15 and the gaps 14 as explained above.

The centrifugal separator comprises a drainage outlet 29 configured to permit discharge of liquid impurities separated from the gas and a gas outlet 30 configured to permit discharge of cleaned gas. The drainage outlet is in this embodiment arranged as a conduit in the second end wall 6, but the drainage outlet 29 may also be in the form of through holes arranged in the lower end wall 6 so that separated liquid impurities flow through the second bearing 13 as they are drained from the separation space 3. Furthermore, the gas outlet 30 is in this embodiment arranged in the second end wall 6 at a radial distance that is shorter than the radial distance to the drainage outlet 2, but the gas outlet could also be arranged e.g. in the surrounding side wall 4.

By means of control unit 28, the rotational speed and thereby the cleaning efficiency of the centrifugal separator may be controlled in a suitable way so that a required cleaning of the supplied gas is obtained. This is achieved by means of connection 27, which extend into the stationary casing 1 and further through the cap 14 in to the stator 18 of the motor. This connection 27 could also be used for charging the electrical motor 23 with current. The control unit 30 includes a device for driving the electrical motor 23 at different speeds; either so that a limited number of speeds can be obtained or so that a continuous change of the motor speed can be performed. Different kinds of devices for speed regulation of motors (both direct-current and alternate-current motors) are well known. For a direct-current motor a simple device for voltage control may be used. For an alternate-current motor various kinds of frequency control equipment may be used.

The control unit 28 may further comprise a communication interface 31, such as a transmitter/receiver, via which it may receive data from various sensors or the engine to which the separator is connected and further transmit data to the electrical motor 23.

The received data may for instance include data on a measured pressure from a pressure sensor 32 at the gas inlet 17, as indicated by dotted arrow "A", and/or data related to the number of stops of the engine to which the separator is connected, as indicated by dotted arrow "B". The transmitted data may for instance include a control signal for controlling the speed of the electrical motor 23.

The control unit 28 is further configured to carry out a method for controlling the electrical motor 28 according to embodiments disclosed herein. For this purpose the control unit 28 may comprise a processing unit 33, such as a central processing unit, which is configured to execute computer code instructions which for instance may be stored on a memory 34. The memory 34 may thus form a (non-transitory) computer-readable medium for storing such computer code instructions. The processing unit 33 may alternatively be in the form of a hardware component, such as an application specific integrated circuit, a field-programmable gate array or the like.

In this embodiment, the control unit 28 is a separate unit from the centrifugal separator 1. However, the control unit may also be a part of the separator, such as forming a part of the electrical motor 23. Thus, the control unit with all its functions could be arranged at the electrical motor, such as being connected to the stator 24 supported by the cap 19.

During operation, the rotating member 17 is kept in rotation by supply of current to the electrical motor 23 and contaminated gas, e.g. crankcase gas from the crankcase of an internal combustion engine, is supplied to the gas inlet 17 via conduit 18. This gas is conducted further into the central space 15 and from there into and through the interspaces 14 between the separation discs of the stack 9. As a consequence of the rotation of the rotating member 7 the gas is brought to rotate, whereby it is pumped further on radially outwardly through gaps or interspaces 14.

During the rotation of the gas in the interspaces solid or liquid particles suspended in the gas are separated therefrom. The particles settle on the insides of the conical portions 9*b* of the separation discs and slide or run after that radially outwardly thereon. When the particles and/or liquid drops have reached out to the outer edges of the separation discs, they are thrown away from the rotor and hit the inner surface of the surrounding wall 4 of the stationary casing 2. The particles continue downwardly along this wall and leave the separation space 3 through the drainage outlet 29, whereas the gas freed from particles and exiting from the stack of separation discs 9 leaves the casing 1 through the gas outlet 30. The path of the gas through the centrifugal separator 1 is schematically shown by arrows "C" in FIG. 1.

As discussed above, the control unit 28 controls the rotational speed of the rotating part by sending signal to the electrical motor 23. During normal operation, the rotating member is rotated at a first speed during a separation phase. This first speed may be a speed in the range of 7,500-12,000 rpm. During the separation phase, liquid impurities are separated from the gas as discussed above. The separation phase may also comprise rotating the rotating member at more than one speed. The separation phase may thus comprise a set of speed levels between which the rotating member can rotate. These shifts within the separation phase may be controlled by control unit 28, either a stepwise or continuous shift in speed.

However, during time, clogging may build up between the separation discs in the stack 9. The control unit is therefore configured to shift into a cleaning phase, in which the rotating member gets a temporary increase in speed. Thus, the cleaning phase occurs during a shorter period of time compared to the separation phase. The speed during the cleaning phase, i.e. the second speed, is higher than the all speeds during the separation phase, i.e. higher than the first speed. The speed during the cleaning phase may be at least 15,000 rpm. The cleaning phase may continue for at least 30 sec, such as at least 45 sec, such as at least 60 sec. With this temporary speed increase, the centrifugal forces acting on the clogging increases, which in turn force the clogging to be released from between the discs, i.e. the separation discs are cleaned from the clogging.

The control unit 28 may for example be configured to shift from the separation phase to the cleaning phase after a predetermined time period, or after receiving input from a sensor. As an example, the control unit may be configured to shift into the cleaning phase after a signal from a pressure sensor 32 at the gas inlet, which signal may be an indication of a gas pressure above a certain threshold and therefore an indication that clogging has occurred. The control unit 28 may as an alternative, or as a complement, be configured to shift to the cleaning phase after receiving an input signal from other parts of the engine to which the centrifugal separator is connected. As discussed above, the control unit may be configured to receive a signal that is related to a stop of the engine to which the centrifugal separator is connected, further configured to switch to the cleaning phase after receiving a predetermined number of stop signals of the engine, or receiving a signal with information that the engine has stopped a certain number of times.

The control unit may further be configured to switch back to the separation phase after running the rotating member 7 at the speed of the cleaning phase a certain period of time. As an example, the control unit may further be configured to switch from the cleaning phase back to the separation phase after 30-180 s.

An electrical motor 23 of the kind shown in FIG. 1 may alternatively be arranged around an extension of the spindle 8 below the lower bearing 13. It is also possible to arrange the motor in a space axially between the upper bearing 12 and the first end plate 10 or axially between the lower bearing 13 and the second end plate 11. An electrical motor having a disc-formed circular rotor and a stator formed so that it is situated axially on both sides of the rotor may also be used.

Figure 2:
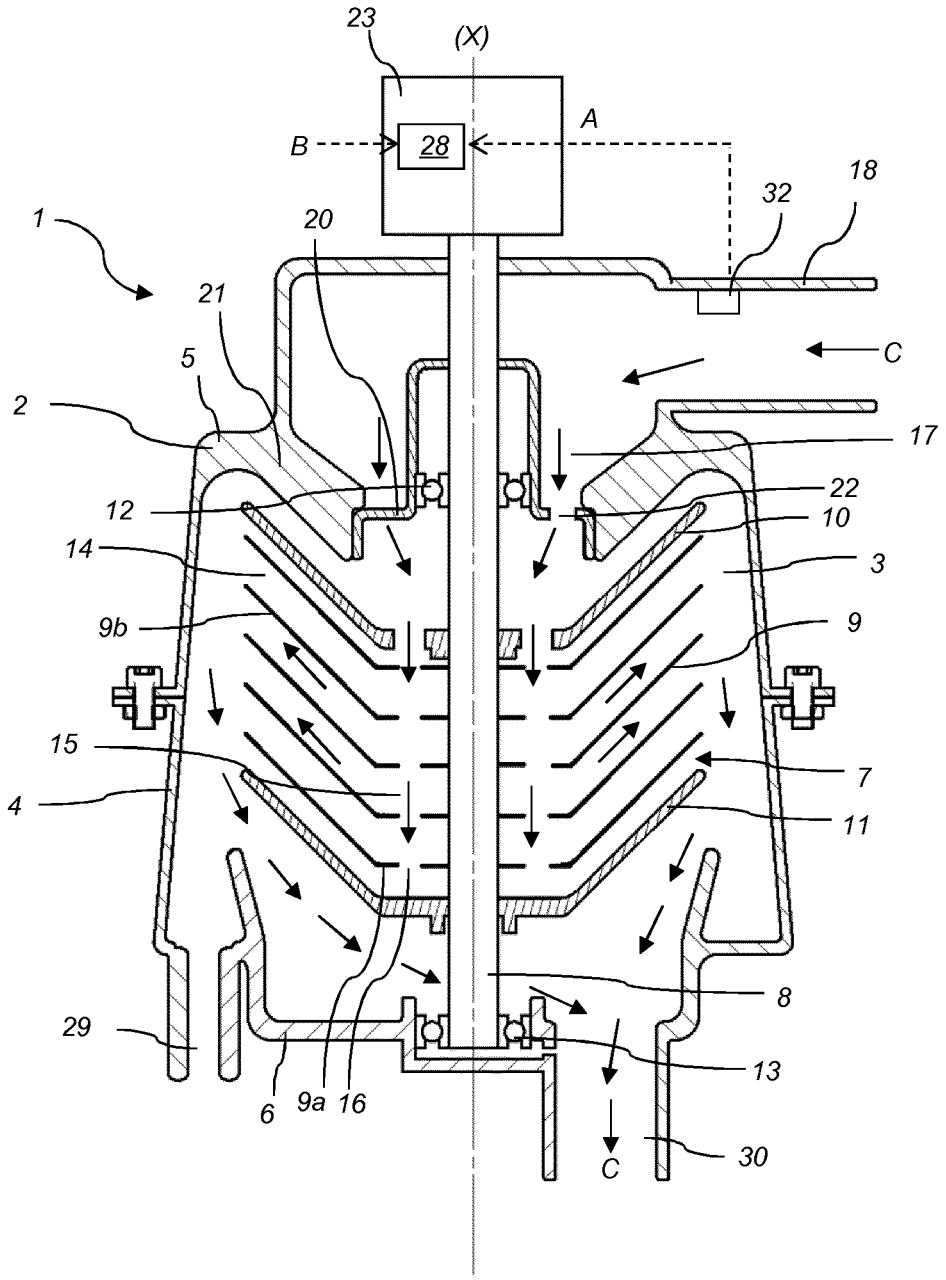
FIG. 2 shows a section of an embodiment of a centrifugal separator.

FIG. 2 shows an example of an embodiment of a centrifugal separator in which the electrical motor 23 is arranged on an extension of the spindle 8 axially above the upper wall 5 of the stationary casing 2. As an alternative, the electrical motor 23 could also be arranged on an extension of the spindle 8 axially below the lower end wall 6 of the stationary casing 2.

Thus, in the embodiment shown, the stator and the rotor of the electrical motor 23 are arranged outside the stationary casing 2. Further, the control unit 28 is arranged as a part of the electrical motor 23, but functions as discussed in relation to the embodiment shown in FIG. 1. All other functions are the same as discussed in relation to the embodiment shown in FIG. 1, i.e. the reference numerals denote the same features.

In the embodiments shown in FIG. 1 and FIG. 2, the rotating member 7 for the gas cleaning is provided with a stack of conical separation discs of a conventional kind. However, the invention is not limited to a rotating member or centrifugal rotor of precisely this kind but may be used in connection with any suitable centrifugal rotor for freeing a gas from particles suspended therein.

FIG. 3*a-d* shows a few examples of separation discs that may be used in a centrifugal separator of the present disclosure. For clarity reasons, only a few discs are illustrated and it is to be understood that in reality, a larger number of discs are present so that the distance between the discs is much smaller.

Figure 3A:
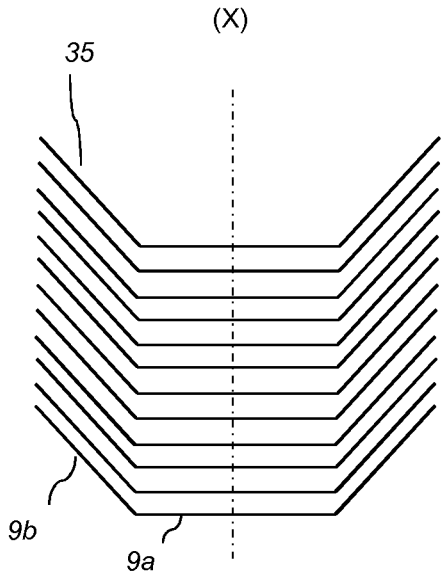
FIG. 3*a-d* show different types of separation members that may be used in the centrifugal separator.

FIG. 3*a* shows an example of frustoconical discs 35 having a planar portion 9*a* and a frustoconical portion 9*b*. The planar portion 9*a* extends in a plane that is perpendicular to the axis of rotation (X), and the frustoconical portion 9*b* extends in this embodiment upwards. The planar portion 9*a* is closer to the rotational axis than the frustoconical portion 9*b*. The planar portion 9*a* and/or the frustoconical portion 9*b* may comprise through holes for gas.

Figure 3B:
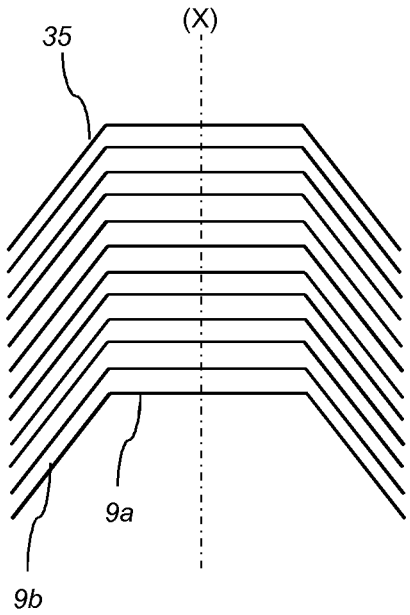

FIG. 3*b* shows an example of frustoconical discs 35 having a planar portion 9*a* and a frustoconical portion 9*b*. The planar portion 9*a* extends in a plane that is perpendicular to the axis of rotation (X), and the frustoconical portion 9*b* extends in this embodiment downwards. The planar portion 9*a* is closer to the rotational axis than the frustoconical portion 9*b*. The planar portion 9*a* and/or the frustoconical portion 9*b* may comprise through holes for gas.

Figure 3C:
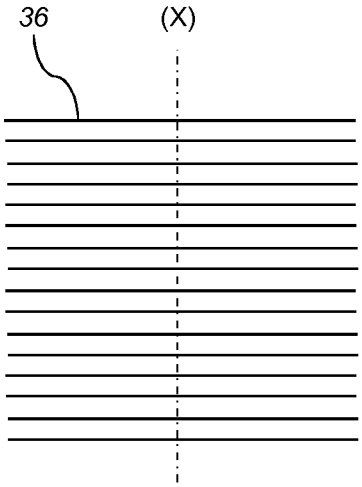

FIG. 3*c* shows an example of a disc stack in which all discs 36 are planar, i.e. all discs 36 extend in the plane that is perpendicular to the axis of rotation (X). The discs 36 may comprise through holes for gas.

Figure 3D:
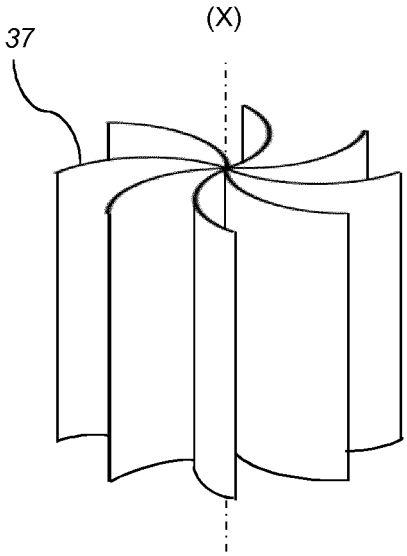

FIG. 3*d* shows an example of axial discs or plates 37. These plates 37 are slightly curved, i.e. they have a curved shaped as seen in a radial plane. In other words, they are curved as seen in a plane that is perpendicular to the axis of rotation (X). The axial discs 37 may comprise through holes for gas.

The invention is not limited to the embodiment disclosed but may be varied and modified within the scope of the claims set out below. The invention is not limited to the orientation of the axis of rotation (X) disclosed in the figures. The term "centrifugal separator" also comprises centrifugal separators with a substantially horizontally oriented axis of rotation.

The invention claimed is:

1. A centrifugal separator for cleaning gas containing contaminants comprising:
- a stationary casing enclosing a separation space through which a gas flow is permitted;
- a gas inlet extending through the stationary casing and permitting supply of the gas to be cleaned;
- a rotating member comprising a plurality of separation members arranged in said separation space and being arranged to rotate around an axis of rotation;
- a gas outlet configured to permit discharge of cleaned gas and comprising an outlet opening through a wall of the stationary casing;
- a drainage outlet configured to permit discharge of liquid impurities separated from the gas to be cleaned;
- a drive member for rotating the rotating member; and
- a control unit configured to:
  - control the drive member to rotate the rotating member at a first speed during a separation phase;
  - receive a signal regarding an operation parameter of the separator or an engine connected to the separator;
  - in response to the signal, rotate the rotating member at a second speed, which is higher than the first speed, during a cleaning phase to remove clogging on or between said separation members; and
  - control a duration of the cleaning phase to be shorter than a duration of the separation phase.

2. The centrifugal separator according to claim 1, wherein the signal is received after a predetermined period of time.

3. The centrifugal separator according to claim 1, wherein the signal is related to a stop of the engine, and
- wherein the control unit is further configured to switch to the cleaning phase after a predetermined number of stops of said engine.

4. The centrifugal separator according to claim 1, wherein the signal is related to the time during which the engine has been running, and
- wherein the control unit is further configured to switch to the cleaning phase when said time exceeds a threshold value.

5. The centrifugal separator according to claim 1, wherein the signal is related to the gas pressure at the gas inlet; and
- wherein the control unit is further configured to switch to the cleaning phase when the gas pressure at the gas inlet is above a predefined threshold value.

6. The centrifugal separator according to claim 1, wherein the cleaning phase comprises rotating the rotating member during a time period that is between 30-180 s.

7. The centrifugal separator according to claim 1, wherein the cleaning phase comprises rotating the rotating member at a speed that is higher than 12,000 rpm.

8. The centrifugal separator according to claim 1, wherein the cleaning phase comprises rotating the rotating member at a speed that is more than 2000 rpm higher than the speed of the separation phase.

9. The centrifugal separator according to claim 1, wherein the drive member comprises an electrical motor.

10. The centrifugal separator according to claim 9, wherein the rotating member is journalled in the stationary casing through bearings situated at only two bearing places axially spaced from each other, and wherein the electrical motor is arranged within the stationary casing and has a stator, that is supported by the stationary casing, and a rotor, that is constituted by part of said rotating member, the rotating member being journalled relative to the stator only through said bearings.

11. The centrifugal separator according to claim 9, wherein the control unit is integrated with the electrical motor.

12. A method for removing clogging in a centrifugal separator, comprising the steps of:

providing the centrifugal separator according to claim 1;

running the centrifugal separator in the separation phase at said first speed; and switching to running the centrifugal separator in the cleaning phase at said second speed to remove clogging on or between said separation members.

13. The method according to claim 12, wherein switching to running the centrifugal separator in the cleaning phase is additionally initiated after a predetermined period of time.

14. The method according to claim 12, further comprising receiving a signal related to a stop of the engine to which the centrifugal separator is connected, and wherein switching to running the centrifugal separator in the cleaning phase is initiated after a predetermined number of received stops.

15. The method according to claim 12, further comprising measuring a pressure at the inlet of the separator, and wherein switching to running the centrifugal separator in the cleaning phase is initiated when the gas pressure at the gas inlet is above a predefined threshold value.

16. The centrifugal separator according to claim 2, wherein the cleaning phase comprises rotating the rotating member during a time period that is between 30-180 s.

17. The centrifugal separator according to claim 3, wherein the cleaning phase comprises rotating the rotating member during a time period that is between 30-180 s.

18. The centrifugal separator according to claim 4, wherein the cleaning phase comprises rotating the rotating member during a time period that is between 30-180 s.

19. The centrifugal separator according to claim 5, wherein the cleaning phase comprises rotating the rotating member during a time period that is between 30-180 s.

20. The centrifugal separator according to claim 2, wherein the cleaning phase comprises rotating the rotating member at a speed that is higher than 12,000 rpm.

* * * * *